US008573359B2

(12) United States Patent
West

(10) Patent No.: US 8,573,359 B2
(45) Date of Patent: Nov. 5, 2013

(54) RAPID ACCESS CASUALTY EXTRACTION (RACE) BELT

(76) Inventor: Patrick C. West, Arlington, VA (US)

( * ) Notice: Subject to any disclaimer, the term of this patent is extended or adjusted under 35 U.S.C. 154(b) by 446 days.

(21) Appl. No.: 12/800,697

(22) Filed: May 20, 2010

(65) Prior Publication Data

US 2011/0284322 A1 Nov. 24, 2011

(51) Int. Cl.
*A62B 1/16* (2006.01)

(52) U.S. Cl.
USPC ..... 182/3

(58) Field of Classification Search
USPC ..... 182/3, 6; 224/184; 119/770
See application file for complete search history.

(56) References Cited

U.S. PATENT DOCUMENTS

| | | | | |
|---|---|---|---|---|
| 5,318,209 | A * | 6/1994 | Rader et al. | 224/250 |
| 5,881,487 | A * | 3/1999 | Chalker | 42/85 |
| 6,205,584 | B1 | 3/2001 | Yocco | |
| 6,732,834 | B2 * | 5/2004 | Colorado | 182/6 |
| 7,086,091 | B2 | 8/2006 | Jordan | |
| 7,201,299 | B2 * | 4/2007 | Forsman | 224/148.2 |
| 7,467,419 | B2 | 12/2008 | O'Neal et al. | |
| 8,146,785 | B2 * | 4/2012 | Pruitt | 224/219 |
| 2001/0047904 | A1 * | 12/2001 | Antonio | 182/3 |
| 2007/0199767 | A1 * | 8/2007 | Altieri | 182/3 |
| 2009/0095232 | A1 * | 4/2009 | McKay | 119/770 |
| 2010/0193288 | A1 * | 8/2010 | Colorado | 182/3 |
| 2010/0206921 | A1 * | 8/2010 | Shen | 224/150 |
| 2011/0067953 | A1 * | 3/2011 | Kopp | 182/3 |

FOREIGN PATENT DOCUMENTS

WO WO 2009/042499 A1 * 4/2009

* cited by examiner

*Primary Examiner* — James O Hansen
*Assistant Examiner* — Kristine Florio
(74) *Attorney, Agent, or Firm* — Frank Lachenmaier

(57) ABSTRACT

The present invention relates generally to a casualty recovery device that allows for a hands free recovery or extraction, either in a combat theatre or any other emergency rescue operation where hands free operation is of significant benefit and time is of the essence.

1 Claim, 10 Drawing Sheets

RAPID ACCESS CASUALTY EXTRACTION (RACE) BELT

BACKGROUND

1. Field of Invention

The present invention relates generally to a casualty recovery device that allows for a hands free recovery or extraction of a casualty in a law enforcement, military or other emergency rescue operation where hands free withdrawal of the casualty is of significant benefit and time is of the essence.

2. Prior Art

Current methods of casualty extraction systems or devices suffer form several deficiencies. Four man teams often operate in combat zones much of the time away from their vehicles. If a member of a team is injured, or injured under fire, the best option is often extraction to a covered zone where he can be treated out of the line of fire.

The litter is a conventional device for extraction of casualties that requires taking the litter to the casualty, placing the litter on the ground, placing the casualty on the litter and one or two men to pick up the litter and carry or drag the casualty to safety. All the while the rescuers are not in a hands-free, defensive posture with their weapons ready or firing.

Harnesses with pull handles or straps need to be worn in anticipation of becoming a casualty and are therefore not always available when needed. Sometimes the casualties are either civilians or even members of an enemy force that require treatment and may not be wearing anticipatory rescue gear.

Straps that can be wrapped around a casualty's feet or attached to the back ring of the vest worn by most soldiers in a combat zone are not a standard part of the soldier's gear at ready. They must be removed from a back pack; fastened around the waist of the rescuer; the end stuffed into his pocket; the casualty approached, sometimes under fire; the rescuer's weapon set aside; the strap pulled from his pocket and fastened to the casualty's vest or wrapped around his feet; the weapon retrieved and backing away dragging the casualty to a covered location while returning fire.

All three of the above mentioned methods require excessive time that the rescuer is not able to return fire. Studies have shown that the key to successful extractions is maintaining fire superiority during the rescue. The few seconds difference in time to approach, attach and drag away can be a life and death matter in an emergency or under fire condition. Currently a major topic in the tactical world is care under fire. Not being able to return fire during the complete rescue operation is a major drawback.

SUMMARY OF THE INVENTION

One of the objectives of the RACE Belt is to provide an extraction system that is a standard part of every rescuers uniform, not taking up valuable real estate on the soldier's uniform or space and weight in his backpack.

Another objective of the RACE Belt is for it to be a modification to an existing platform, i.e., the riggers/CQB (Close Quarter Combat) belt that is already known and trusted by the tactical community without adding weight or requiring additional space.

Another objective of the RACE Belt is for a drag strap to attach at a triangular load bearing coupling on a riggers belt.

Another objective of the RACE Belt is for the attached drag strap to be readily disconnectable from the riggers belt.

Another objective of the RACE Belt is for the quick disconnect mechanism to be shielded from accidental release.

Another objective of the RACE Belt is for a drag strap to have several different available lengths to adjust for the height of the operator and the desired drag angle for the casualty.

Another objective of the RACE Belt is for a drag strap to be easily refolded and stored in an open ended pocket mounted on the side opposite the rescuer's dominant hand on the outside of a riggers belt.

Another objective of the RACE Belt is for a drag strap to be at the ready, easy to deploy and attach with one hand while holding and/or firing a weapon with the dominant hand.

Another objective of the RACE Belt is to be utilizable to strap a soldier in transport to an open door aircraft preventing accidental fallouts during flight.

The RACE Belt, or Rapid Access Casualty Extraction Belt provides the operator with the ability to maintain the full use of his weapon while rapidly attaching a drag strap to a casualty via the existing drag handle that is standard on the back of all tactical vests (varieties of which are worn by every operator) or wrapping a drag strap around the casualties feet or other attachment point. The RACE Belt builds on an existing platform, i.e., the riggers/CQB belt, which is used extensively in the tactical community. The RACE Belt integrates a low profile carabiner attached at the distal end of a drag strap, a distal end of a quick release shackle attached to the proximal end of a drag strap, a proximal end of a quick release shackle attached to a triangular load bearing coupling on a riggers belt and a storage pouch mounted on the side of a riggers belt. The distal end of a drag strap is folded and it and the carabiner are then stowed in the open-ended elastic storage pouch which is attached to a riggers belt. The storage pouch encases about two thirds of the folded strap and carabiner, allowing for easy and rapid operator deployment. The drag strap can be quickly dropped by pulling on a release strap, opening the quick release shackle, freeing the rescuer from the casualty if necessary. The carabiner can also be used to attach to a structure in an open door aircraft thus securing the soldier in transit.

DRAWINGS

In order that the invention is fully understood it will now be described with reference to the following drawings in which.

DESCRIPTION

Figure 5:
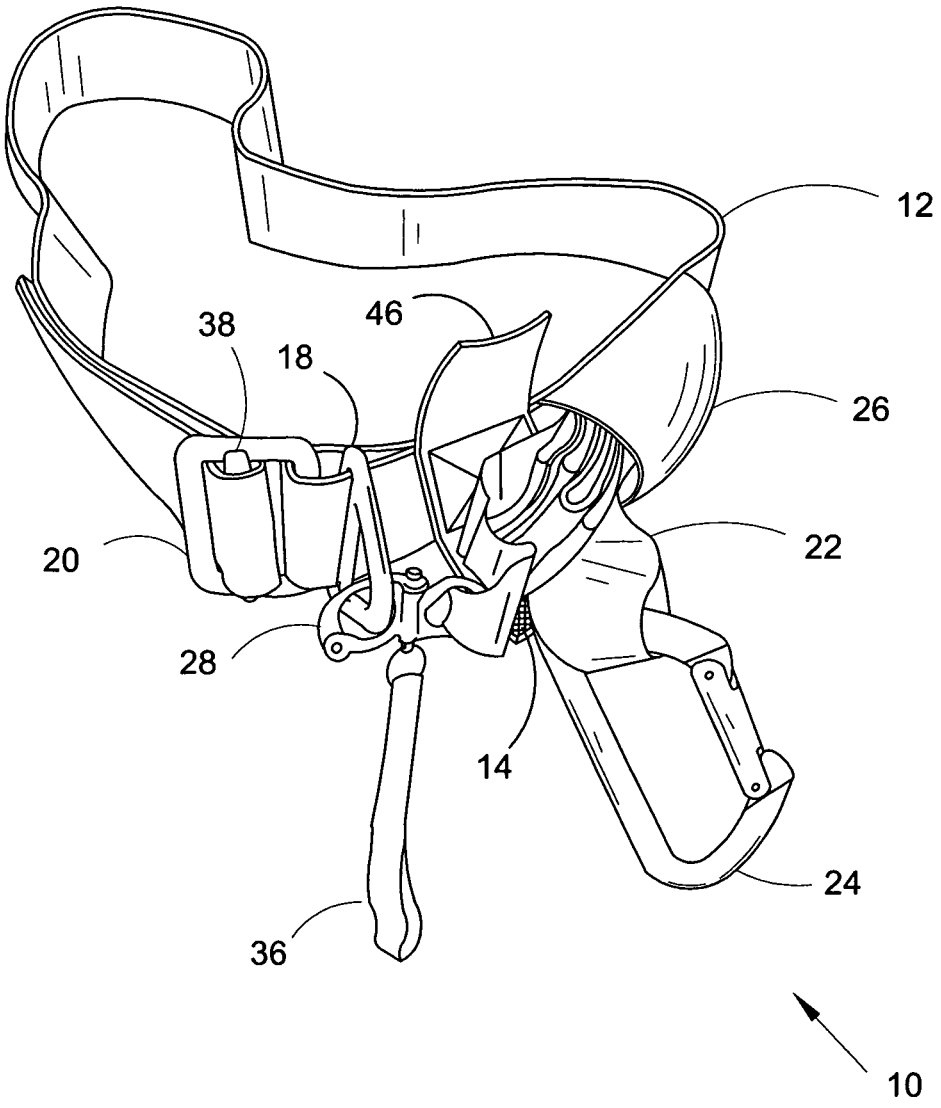
FIG. 5 is a perspective view of RACE Belt with its drag strap in a stored position with keeper/silencer open.
Figure 5A:
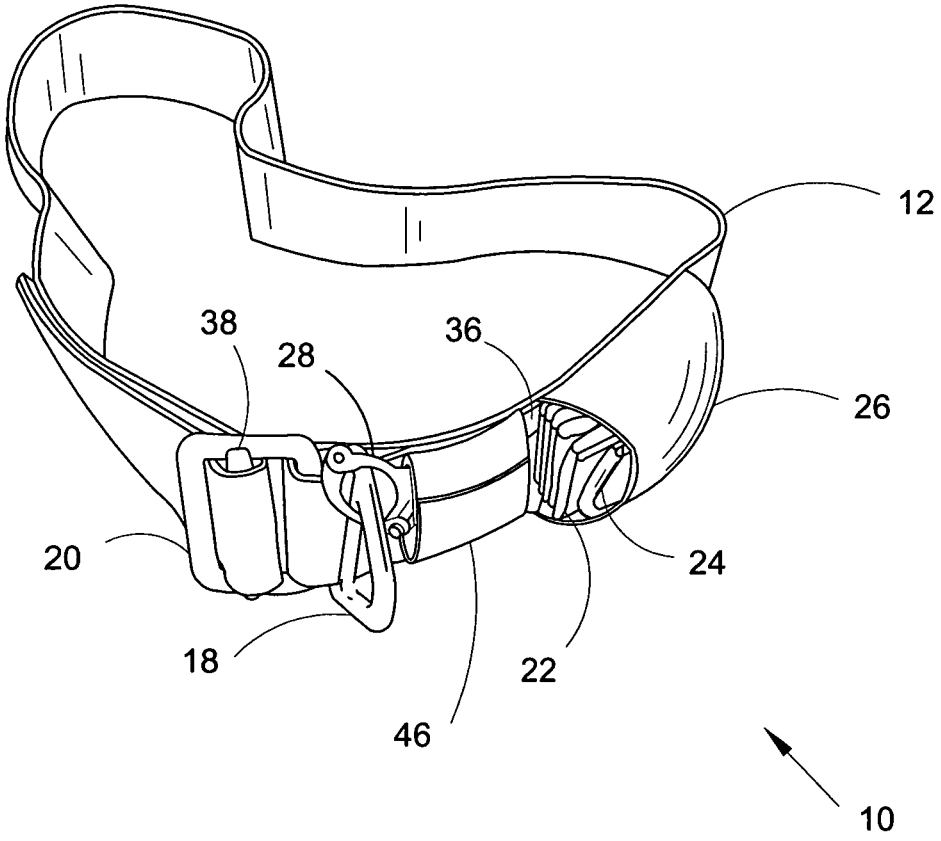
FIG. 5A is a perspective view of RACE Belt with its drag strap in a stored position with keeper/silencer closed.

In order that RACE Belt 10 is fully understood it will now be described by way of the following examples. This new invention is a rapid access casualty extraction device. It is built on the standard riggers/CQB belt 12 that most soldiers in combat wear as part of their uniform. RACE Belt 10 is comprised of riggers belt 12 with a forward opening pouch 26 attached to one side and triangular load bearing coupling 18 connected at the rear of buckle 20 as shown in FIGS. 1, 1A, 2 and 2A. The proximal end of Drag strap 22 is connected to triangular load bearing coupling 18 with a quick disconnect shackle 28. Drag strap 22 is folded on marked-in-red fold lines 32, and inserted into pouch 26 as shown in FIGS. 5 and 5A. Pouch 26 is deep enough to encapsulate approximately ⅔ the length of the folded sections of drag strap 22. The distal end of drag strap 22 has a quick connect carabiner 24 attached for connecting to the ring on the back of the vest that soldiers wear as part of their uniform or wrapped around the feet or other lift points of the casualty and hooked back over drag strap 22.

Drag strap 22 also has two alternate attachment loops 34 at intermediate points along its length. Connecting carabiner 24 to one of these loops 34 in essence shortens drag strap 22, allowing for adjustment for the height of the rescuer or the desired drag angle of the casualty. When drag strap 22 with distal ended carabiner 24 attached is folded and inserted into pouch 26, approximately ⅓ of the length of carabiner 24 is exposed as shown in FIG. 5A, making for an easy grasp and pull motion with one hand. Carabiner 24 can be attached to a casualty with one hand while maintaining the rescuer's weapon at the ready or actually laying down a covering fire. If required to quickly disconnect from the casualty to maintain the safety of the rescuer or the casualty, the quick release shackle 28 is activated by pulling quick release strap 36, immediately disconnecting the rescuer from the casualty.

Figure 6:
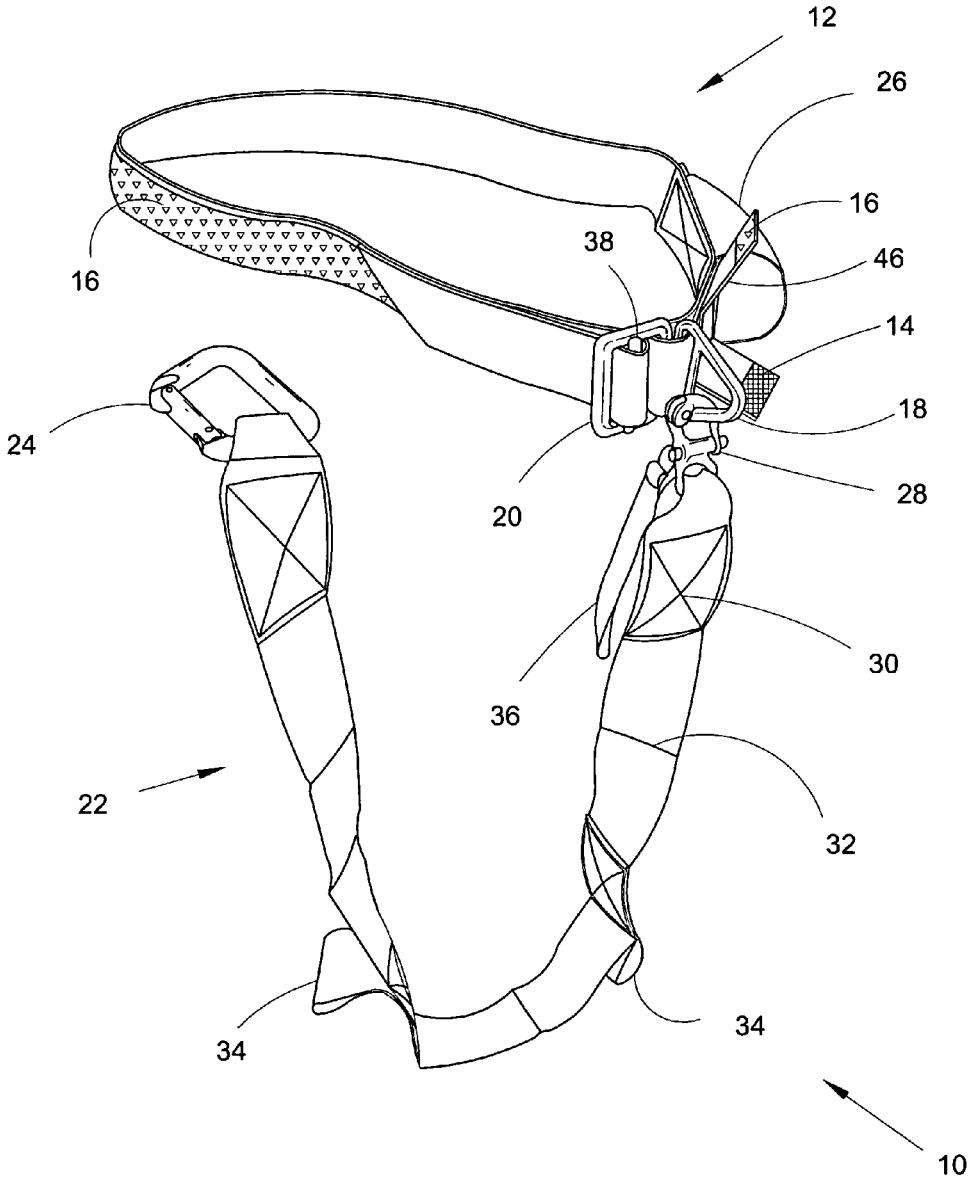
FIG. 6 is a perspective view of RACE Belt in its extended position.

FIGS. 1, 1A, 2, and 2A describe a preferred embodiment of riggers belt 12 that is approximately 48 inches long×1¾ inches wide. It has male hooks 14 on the outside of approximately the first 5 inches of the proximal end of riggers belt followed by approximately 25 inches of female loops 16. Approximately 1½ inches from the distal end of riggers belt 12, keeper/silencer 46 for quick release shackle 28 is formed with an approximately 1¾ inch wide by 6 inches long section of riggers belt 12 material that is attached to the outside of riggers belt 12, approximately centered with its 6 inch axis perpendicular to the length of riggers belt 12. The front side of the material that extends below the bottom edge of riggers belt 12 has a strip of male hooks 14 and the back side of the portion that extends above the top edge of riggers belt 12 has a strip of female loops 16. When drag belt 22, carabiner 24 and quick release strap 36 proximal end are stowed in pouch 26, quick release shackle 28 lays across the center of this section with quick release strap 36. The top section is brought down over quick release shackle 28 and quick release strap 36, the bottom section lifted up firmly against the top section, engaging male hooks 14 with female loops 16 as shown in FIG. 5A. Unwanted activation of the quick release shackle 28 by catching quick release strap 36 inadvertently is thus prevented and potential rattling noises between quick release shackle 28 and triangular load bearing coupling 18 are also silenced that might give away a soldier's position or alert the enemy as to his presence. The distal end of riggers belt 12 is looped through triangular load bearing coupling 18 and buckle 20 and an approximately 6½ inch section of the distal end of riggers belt 12 is folded back on itself and attached o itself with reinforced stitching 30 on all but the last 1½ inches, allowing freedom of rotation of buckle 20 and triangular load bearing coupling 18. The proximal end of riggers belt 12 is slipped through buckle 20, over belt gripper slide 38 and back through buckle 20, cinching against rescuer's waist. Placing proximal end male hooks 14 against female loops 16 secures loose end of riggers belt 12 as shown in FIGS. 5, 5A and 6. Pouch 26 can be formed from the elastomeric materials and is approximately 2¾ inches deep by 2 inches high and the width of riggers belt 12. It is open on buckle 20 side and the opening of pouch 26 begins approximately 3 inches from distal end of riggers belt 12.

Figure 1:
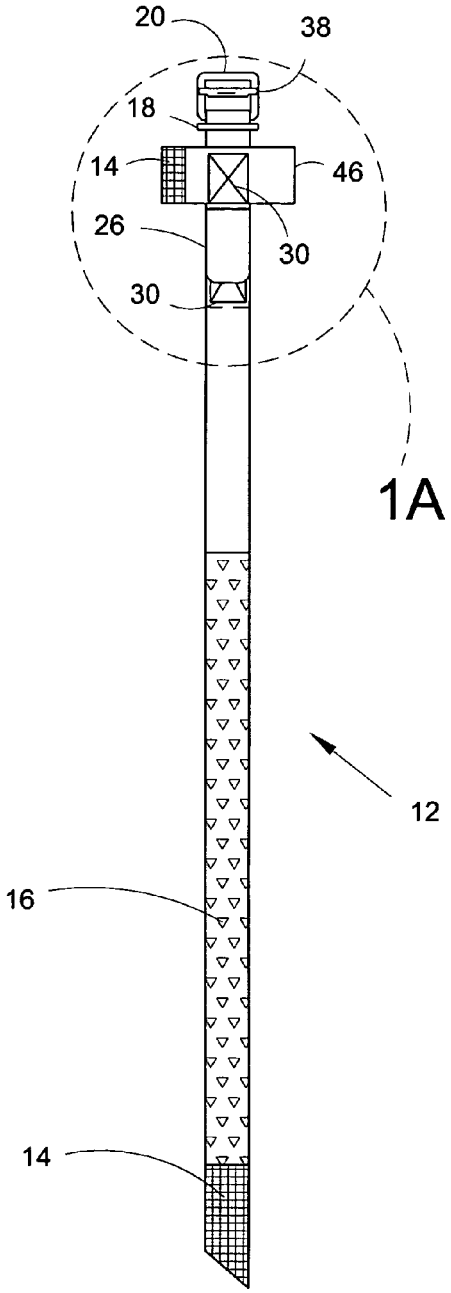
FIG. 1 is a front view of a riggers belt.
Figure 2:
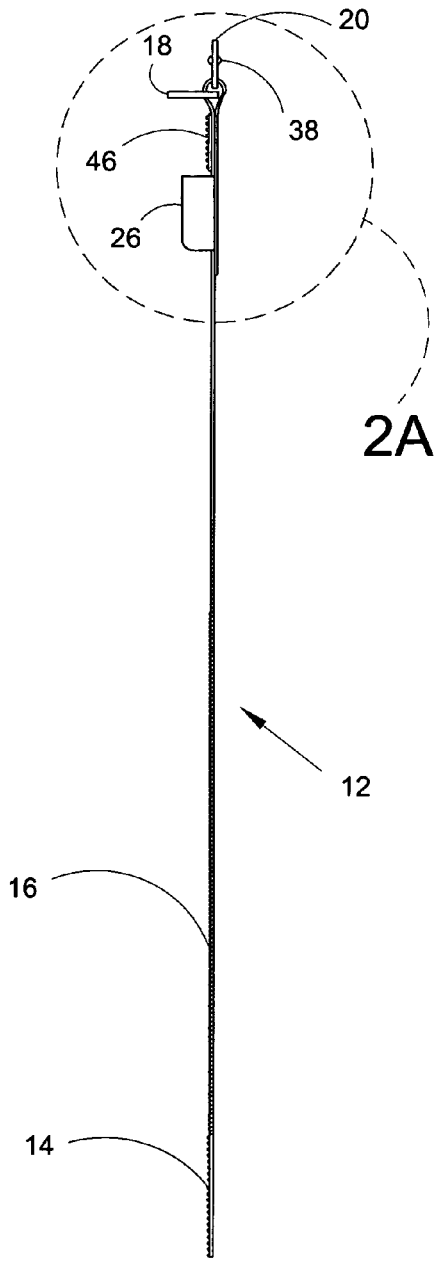
FIG. 2 is a side view of a riggers belt.
Figure 1A:
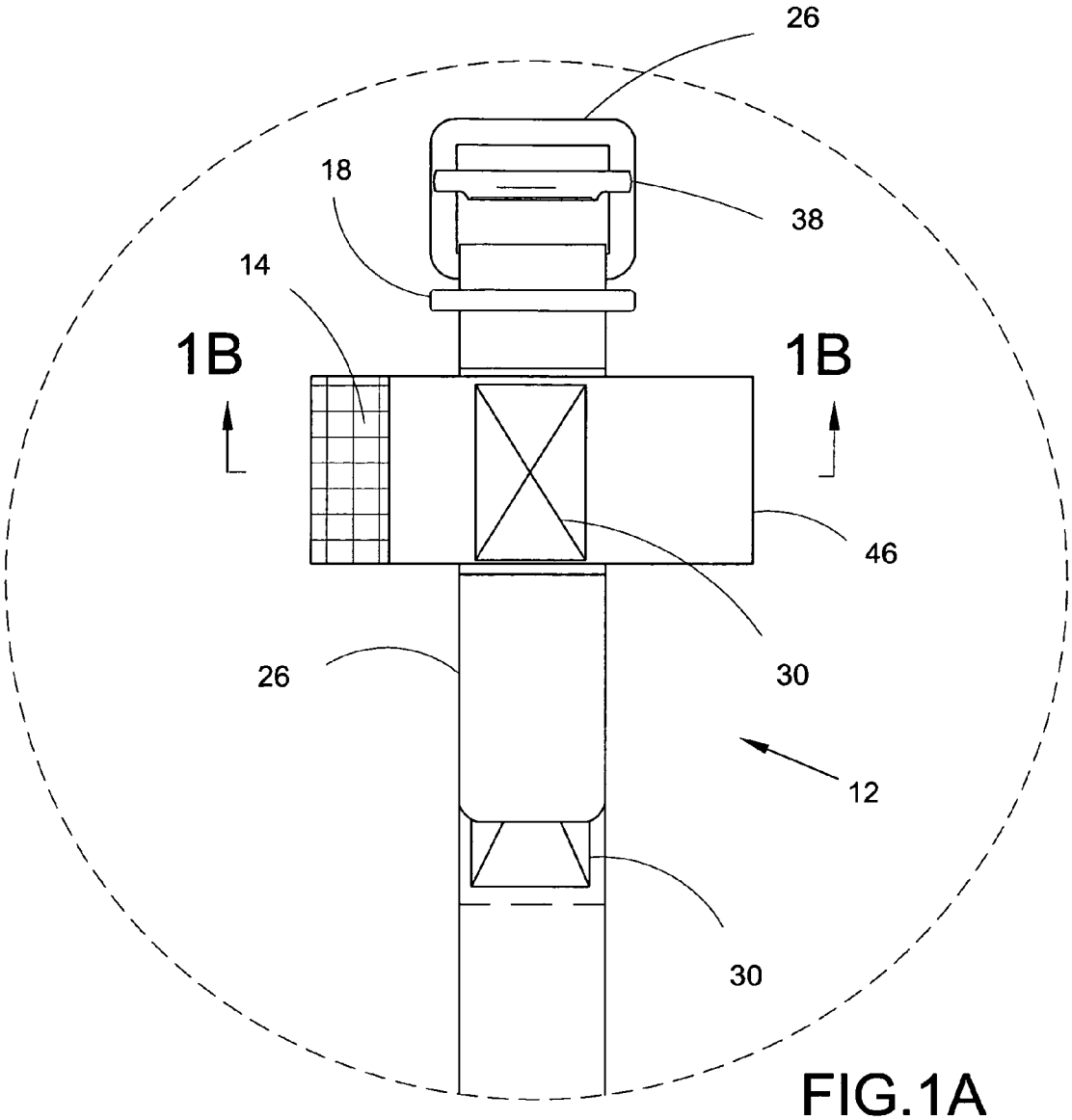
FIG. 1A is an enlarged partial front view of the distal end of a riggers belt.
Figure 1B:
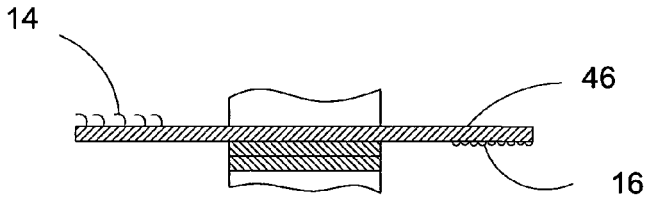
FIG. 1B is a partial section view taken along cutting plain 1B-1B in FIG. 1A.
Figure 2A:
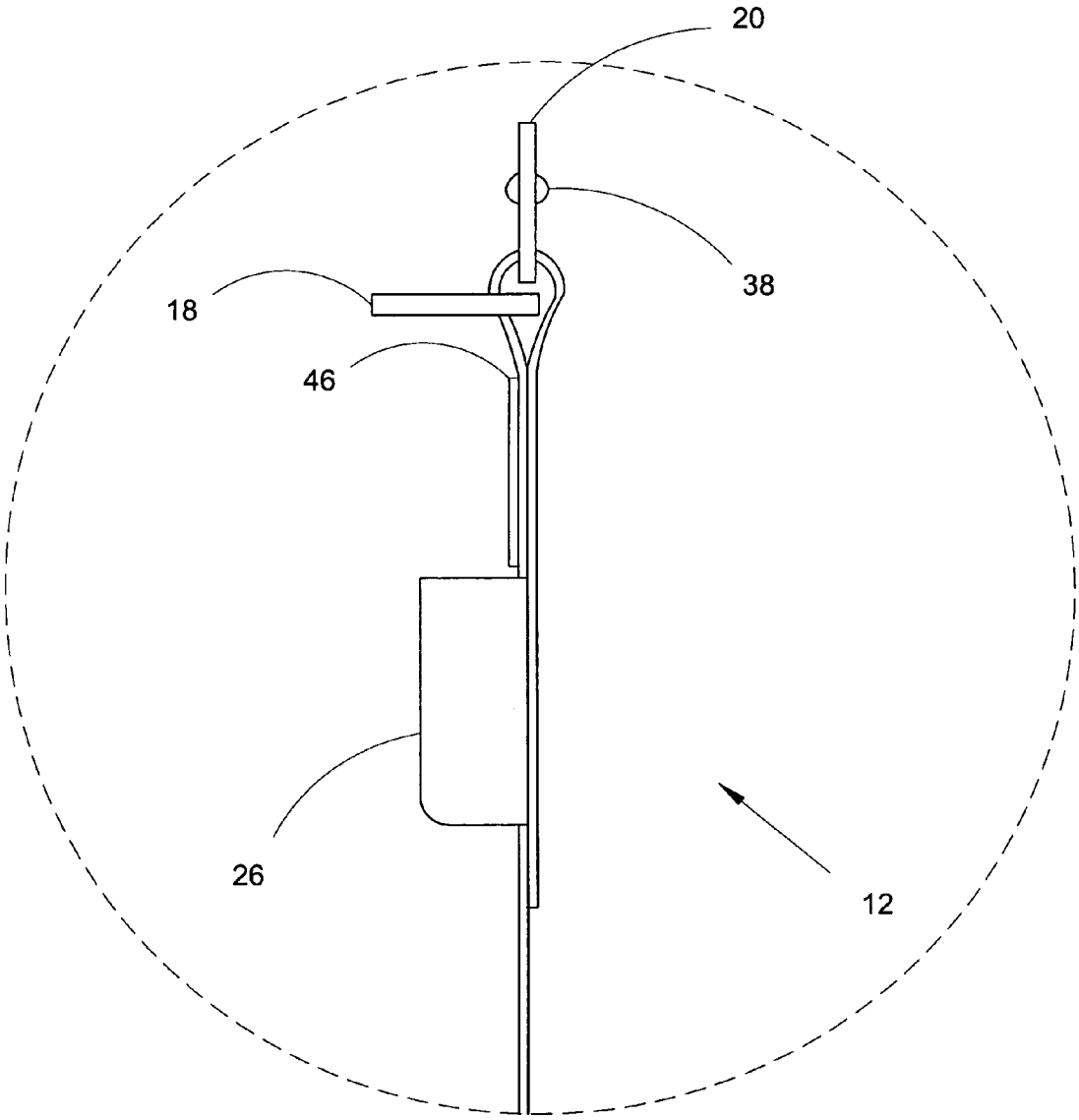
FIG. 2A is an enlarged partial side view of the distal end of a riggers belt.
Figure 3:
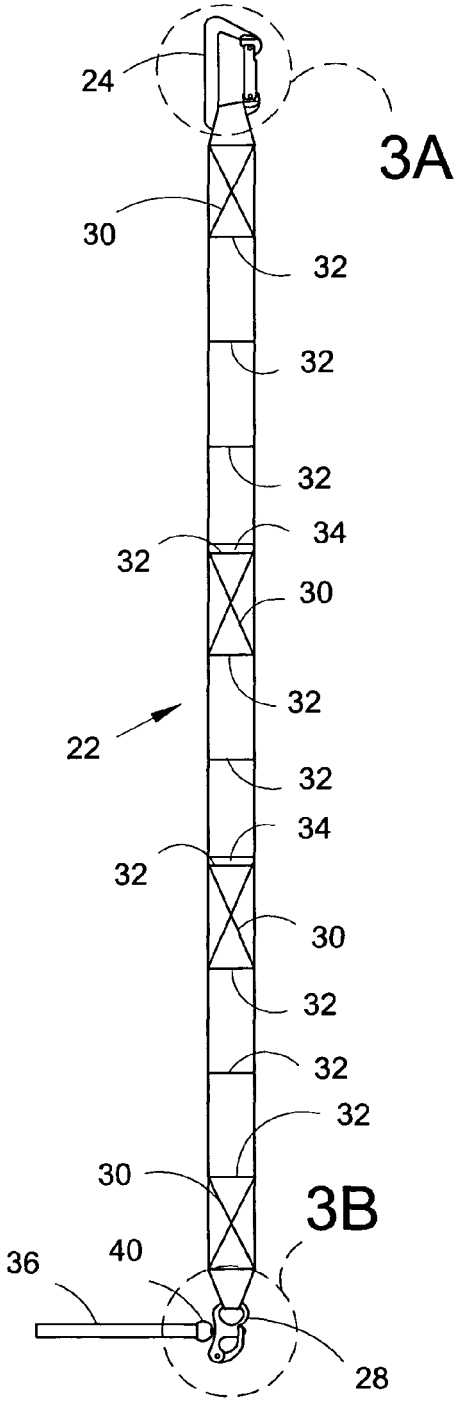
FIG. 3 is a front view of a drag strap.
Figure 4:
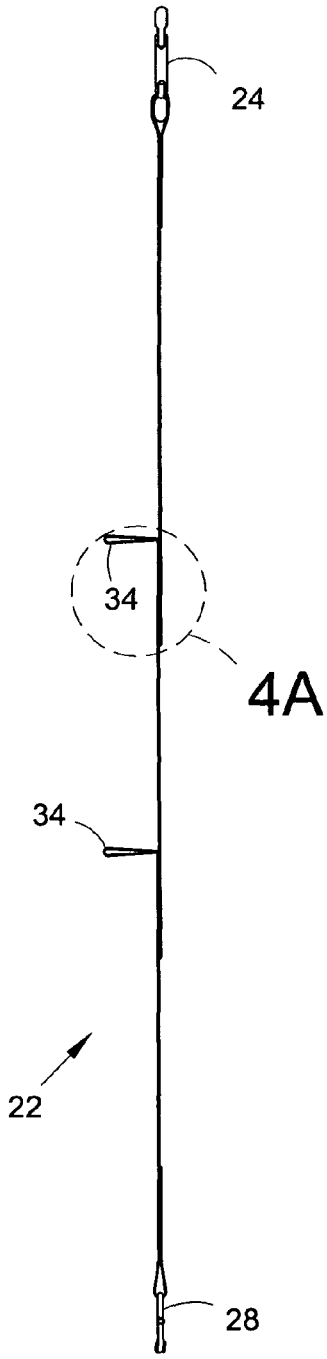
FIG. 4 is a side view of a drag strap.
Figure 3A:
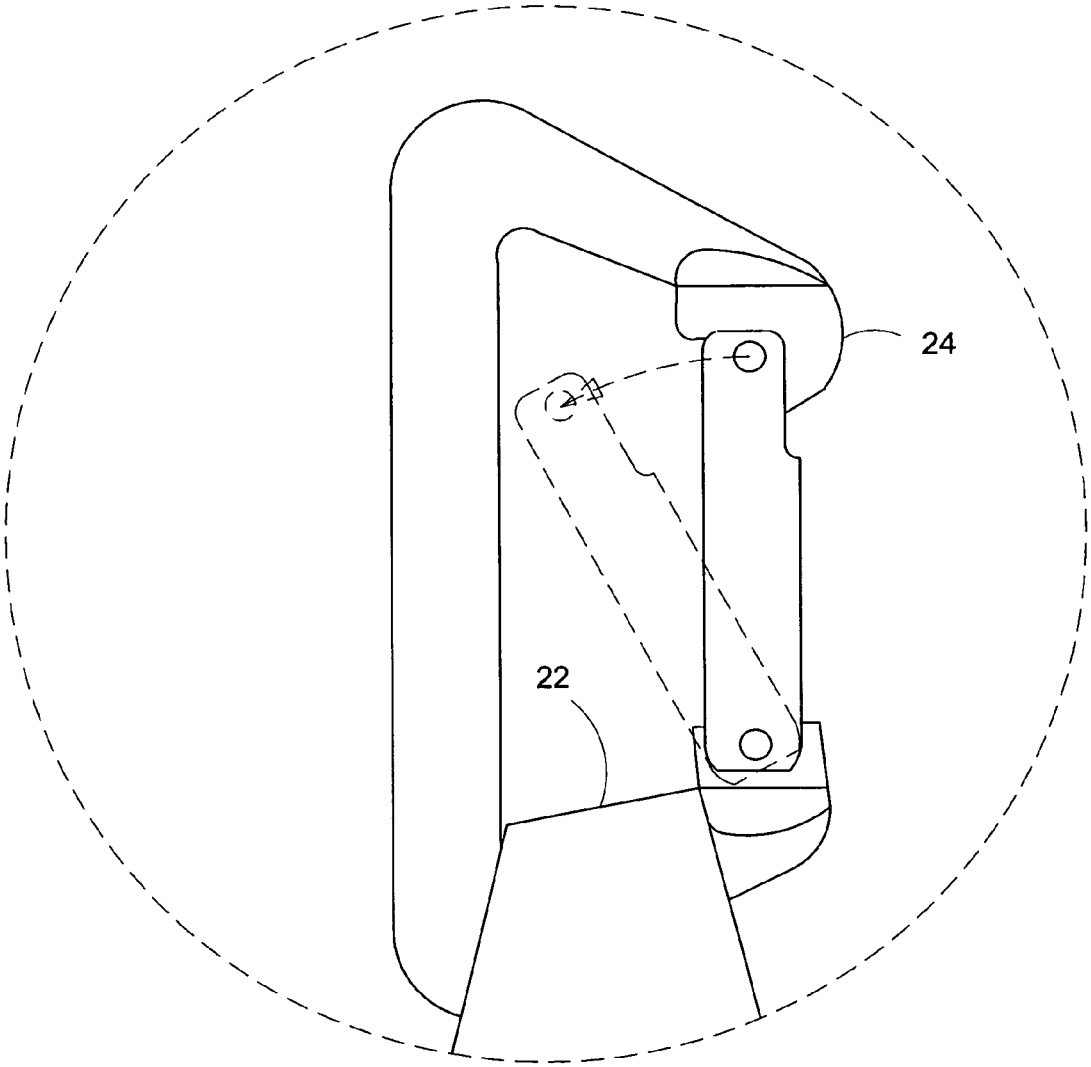
FIG. 3A is an enlarged partial front view of a drag strap showing attached carabiner closed in solid lines and opened in broken lines.
Figure 3B:
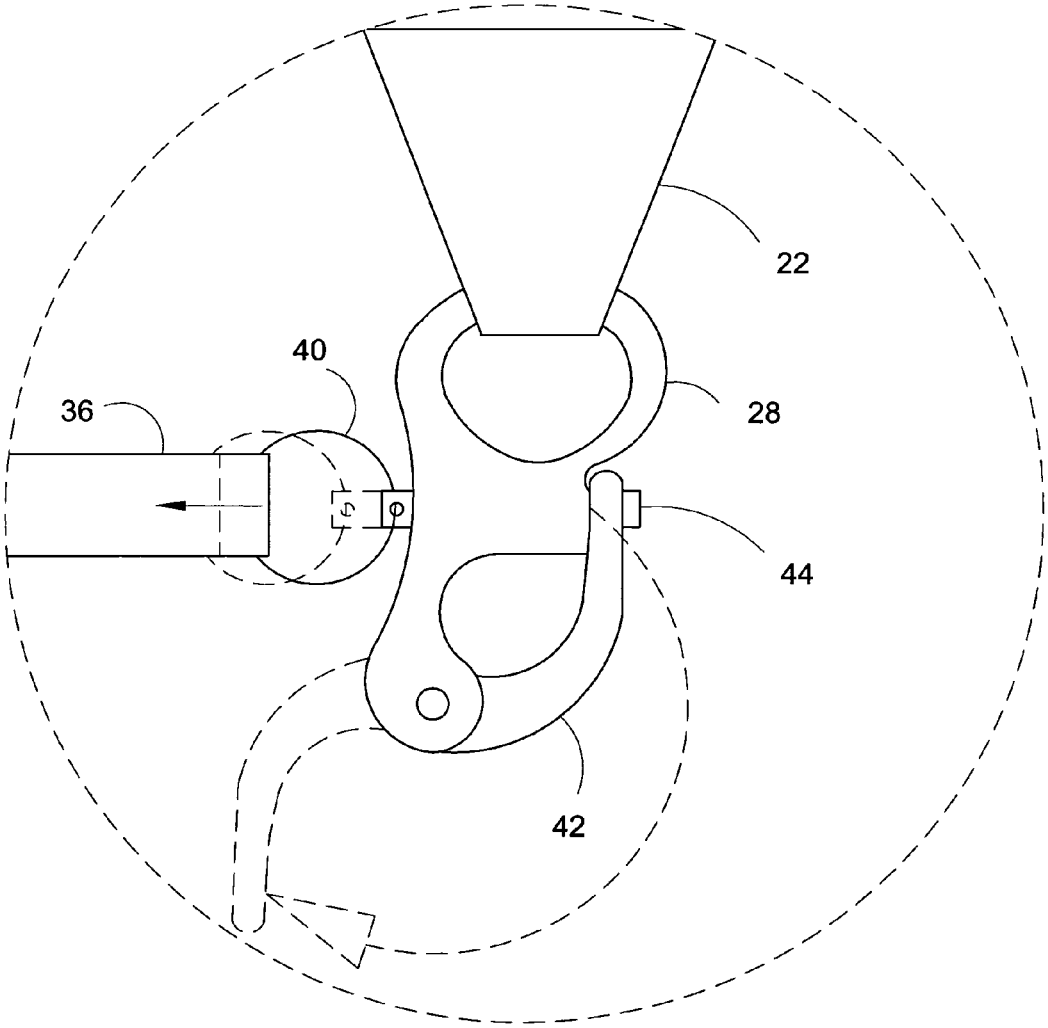
FIG. 3B is an enlarged partial front view of the proximal end of a drag strap showing the quick release shackle closed in solid lines and opened in broken lines.
Figure 4A:
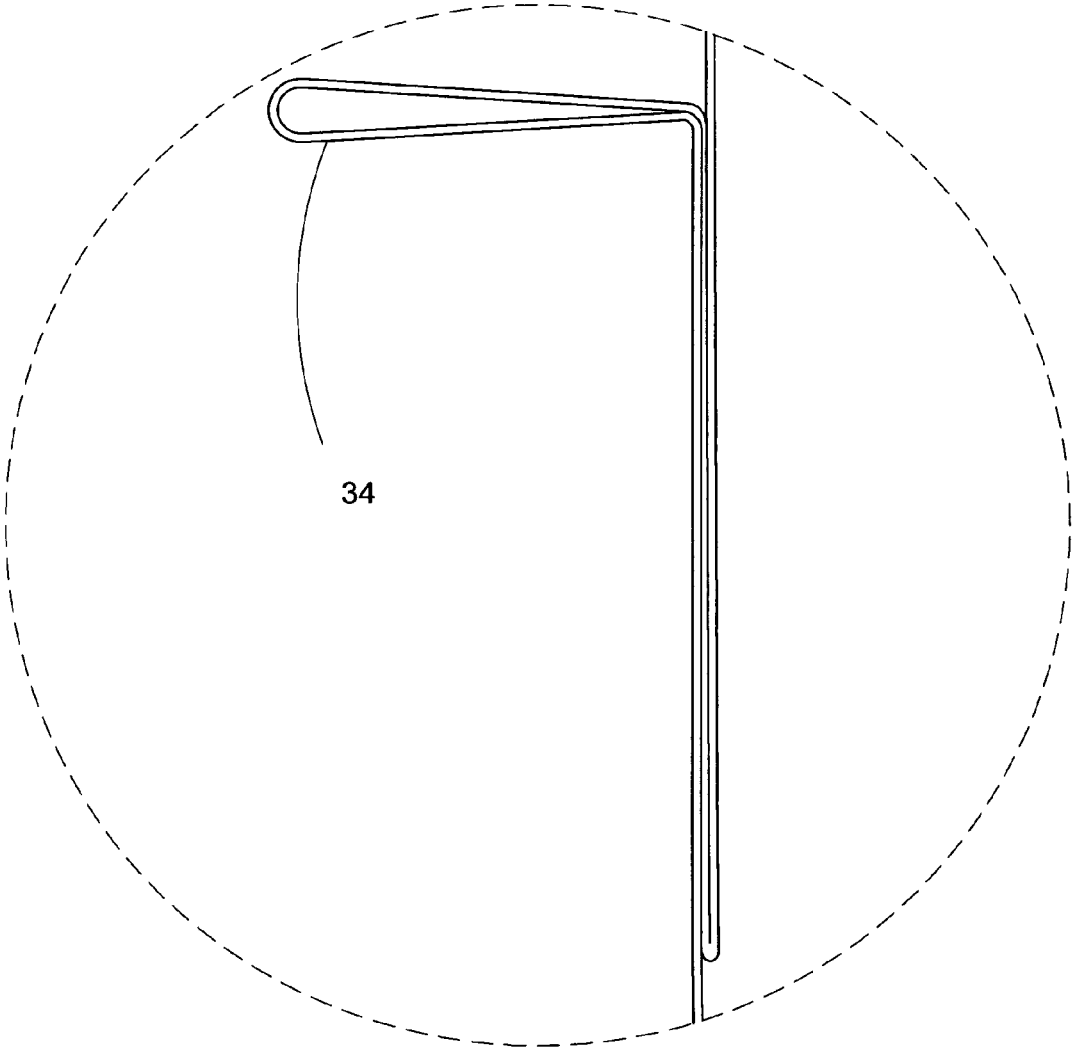
FIG. 4A is an enlarged partial side view of a drag strap showing an alternate attachment loop.

FIGS. 3, 3A, 3B, 4 and 4A describe a preferred embodiment of drag strap 22 that is formed from lighter weight materials to facilitate folding and is approximately 46 inches long. The proximal end of drag strap 22 has an approximately 5 inch long section threaded through the distal end of quick release shackle 28 and folded back on itself and attached to itself with reinforced stitching 30 on all but the last 1½ inches, allowing freedom of rotation for quick release shackle 28. The proximal end of quick release shackle 28 is hooked into triangular load bearing coupling 18 at the distal end of riggers belt 12. The distal end of drag strap 22 has an approximately 5 inch long section threaded through carabiner 24 and folded back on itself and attached to itself with reinforced stitching 30 on all but the last 1½ inches, allowing freedom of rotation of carabiner 24. A red fold line 32 is printed every 4 inches on the outside of drag strap 22 indicating the fold points which will allow the folded strap package to slip fit into pouch 26. Alternate attachment loops 34 are attached at approximately 17 and 29 inches from the proximal end of drag strap 22. Alternate attachment loops 34 can be formed by folding drag strap 22 material back over itself for 6 inches, back under itself for six inches, back under itself again and using reinforced stitching 30 for the first 4 inches through the three layers of drag strap 22 material, producing 2 inch loops as shown in FIGS. 3, 4, and 4A.

Riggers belt 12 is made from standard rigger belt material. Drag belt 22 is made from a lighter weight material with sufficient tensile strength to drag a casualty over rough ground but enough flexibility to allow for multiple folds and insertion of folded drag strap 22 with carabiner 24 attached into pouch 26. Quick release shackle 28 has a fixed loop on its distal end that drag strap 22 is connected through and a proximal end that can connects to triangular load bearing coupling 18 on riggers belt 12. This proximal end of quick release shackle 28 is comprised of latch 42 which is pivotally attached to proximal loop and retained by a spring loaded retention pin 44. The proximal end of retention pin 44 is connected to quick release strap 36 by release pin connector 40. Quick release strap 36 is approximately 6 inches long. When quick release strap 36 is pulled, release pin 44 is retracted and latch 42 opens, allowing separation of riggers belt 12 from drag strap 22.

The descriptions in the above specification are not intended to limit this invention to a 48 inch long riggers belt 12 and 46 inch long drag strap 22, but rather show them for illustration purposes only. One skilled in these arts could easily scale the invention's dimensions and materials to work with any length belt 12, strap 22 and pouch 26. They are also not limited to the widths or thicknesses shown here. RACE Belt 10 may be configured using any or all of the features disclosed here in any combination without diverging from the design intent of this disclosure.

Operation:

When a casualty occurs either in a combat circumstance or an emergency rescue operation and recovery of the casualty requires or is benefited by a quick rescue in a hands free mode, RACE Belt 10 is of significant advantage. RACE Belt 10 recovery or extraction device is ready at hand as a standard part of the rescuer's uniform. A right handed person would have pouch 26 on the left side of his riggers belt 12 with drag strap 22 folded and partially inserted into pouch 26. The rescuer can advance toward the casualty while holding or firing his weapon with his right hand while grabbing carabiner 24 with his left hand. As he approaches the casualty he can pull drag strap 22 out of pouch 26 by carabiner 24. He can either clip carabiner 24 to the back of a vest in one motion or make a quick loop around the casualty's feet, clipping carabiner 24 back over drag strap 22 or clipping it on to alternate attachment loops 34 shortening drag strap 22 for adjustment for the rescuer's height or the preferred drag angle of the casualty. As soon as the connection to the casualty is made the rescuer can begin backing away, dragging the casualty to a safer zone. When the force of dragging a casualty begins, it overcomes the strength of hook 14 and loop 16 seal on keeper/silencer 46, opening keeper/silencer 46 and exposing quick release shackle 28 and quick release strap 36 for activation if required during the extraction. During the dragging part of this rescue, both of his hands are free to either lay down a covering fire or at least have his weapons at the ready in a defensive posture. If it should become necessary to detach from the casualty, for his safety or that of the rescuer, activating the quick release shackle 28 pulling on release strap 36 immediately drops drag strap 22, separating casualty from rescuer.

Many rescuers are flown into rescue sights or soldiers are transported into combat zones in open door aircraft. An additional benefit to RACE Belt 10 is that carabiner 24 at the distal end of drag strap 22 can be attached to any fixed structure on the aircraft or looped over a projection on the aircraft and clipped back onto drag strap 22 thus securing the soldier against accidental fall outs.

What is claimed is:

1. A rapid access casualty extraction device comprising:

a riggers belt with an inside, an outside, a proximal end, a distal end, a buckle with a sliding belt gripper attached to said distal end with a triangular load bearing coupling mounted adjacent to said buckle and an open ended pouch attached on the outside of said riggers belt with said open end of said pouch toward said distal end of said riggers belt, a male hook section on said outside of said proximal end of said riggers belt, followed by a female loop section and a loose end that extends beyond said buckle whereby said loose end of said riggers belt is secured by engaging said hooks into said loops;

a carabiner attached to said distal end of a drag strap;

said drag strap with a proximal end and a distal end where said drag strap has fold line indicators marked on said drag strap such that when said drag strap is folded on said fold line indicators approximately ⅔ the length of said folded drag strap sections and said carabiner fit into said pouch wherein said pouch is made from elastomeric material and is of sufficient height, width and depth to hold multiple folded sections of said drag strap and said carabiner, leaving the remainder of said folded sections and the end of the carabiner exposed for rapid one handed deployment of said drag strap connected carabiner;

a quick release shackle with a proximal end, a distal end, a fixed loop on said distal end, a latchable loop on said proximal end, wherein said distal end of said quick release shackle is attached to said proximal end of said drag strap and said proximal end of said quick release shackle is connected to said load bearing coupling on said riggers belt, a spring loaded normally closed retention pin attached to a quick release strap by a release strap connector such that when said quick release strap is pulled, said retention pin is retracted, allowing a latch portion of said latchable loop to swing open, thereby disconnecting said riggers belt from said drag strap; and, a keeper/silencer comprising an additional strip of said riggers belt material that has a front side and a back side, is attached perpendicularly to said outside of said riggers belt approximately 1½ inches from said distal end of said riggers belt, approximately centered on said keeper/silencer's long axis on said riggers belt, leaving a section above and a section below said riggers belt, where said section below said riggers belt has a strip of male hooks on said front side and said section above said riggers belt has a section of female loops on said back side, where when said quick release shackle and said quick release strap are trapped between said riggers belt and a folded down top section with a folded up bottom section firmly pressed against said back side of said folded down top section, engaging said male hooks with said female loops, accidental activation of said quick release shackle is prevented and rattling noises from contact between said triangular load bearing coupling and said quick release shackle are eliminated creating silent operation in battlefield conditions.

* * * * *